US008952866B2

(12) United States Patent
Oh et al.

(10) Patent No.: US 8,952,866 B2
(45) Date of Patent: Feb. 10, 2015

(54) DOVE TAIL DEVICE IN AN ANTENNA

(75) Inventors: Gun-Seok Oh, Incheon (KR); Byung-Ho Kim, Seoul (KR)

(73) Assignee: Ace Technologies Corporation, Incheon-si (KR)

( * ) Notice: Subject to any disclaimer, the term of this patent is extended or adjusted under 35 U.S.C. 154(b) by 458 days.

(21) Appl. No.: 13/320,009

(22) PCT Filed: May 12, 2010

(86) PCT No.: PCT/KR2010/003010

§ 371 (c)(1),
(2), (4) Date: Jan. 23, 2012

(87) PCT Pub. No.: WO2010/131905

PCT Pub. Date: Nov. 18, 2010

(65) Prior Publication Data

US 2012/0127060 A1 May 24, 2012

(30) Foreign Application Priority Data

May 12, 2009 (KR) ..... 10-2009-0041201

(51) Int. Cl.

| | |
|---|---|
| ***H01Q 15/14*** | (2006.01) |
| ***H01Q 3/32*** | (2006.01) |
| ***H01P 1/18*** | (2006.01) |

(52) U.S. Cl.
CPC . *H01Q 3/32* (2013.01); *H01P 1/184* (2013.01)
USPC ..... 343/912

(58) Field of Classification Search
CPC . H01Q 15/141; H01Q 15/142; H01Q 15/144; H01Q 15/0006; H01Q 15/14
USPC ..... 343/907, 912, 757, 759, 766
See application file for complete search history.

(56) References Cited

U.S. PATENT DOCUMENTS

| | | | | |
|---|---|---|---|---|
| 6,100,856 | A * | 8/2000 | R.ang.be | 343/882 |
| 7,366,545 | B2 * | 4/2008 | Hurler et al. | 455/562.1 |
| 7,639,196 | B2 * | 12/2009 | Elliot et al. | 343/757 |
| 7,872,614 | B2 * | 1/2011 | Gonzalez et al. | 343/915 |
| 2002/0149528 | A1 * | 10/2002 | Heinz et al. | 343/757 |

* cited by examiner

*Primary Examiner* — Huedung Mancuso
(74) *Attorney, Agent, or Firm* — AlbertDhand LLP

(57) ABSTRACT

A dove tail device for adjusting tilting angle of an antenna by rotating an arm member using a motion member which moves linearly is disclosed. The dove tail device in an antenna includes a guide and a motion member configured to move on the guide. Here, the motion member is combined with a rotation arm of a phase shifter, the rotation arm rotates according as the motion member moves on the guide, and an arm member of the phase shifter rotates in response to rotation of the rotation arm.

5 Claims, 6 Drawing Sheets

(A)

(B)

(A)

(B)

DOVE TAIL DEVICE IN AN ANTENNA

TECHNICAL FIELD

Example embodiment of the present invention relates to a dove tail device, more particularly relates to a dove tail device for adjusting tilting angle of an antenna by rotating an arm member using a motion member which moves linearly.

BACKGROUND ART

An antenna transmits/receives an electromagnetic wave by outputting a beam. It is needed that direction of the beam, i.e. tilting angle is adjusted in various directions. Accordingly, the antenna employs a phase shifter of dividing a power and a tilting adjustment apparatus, etc. so as to adjust the tilting angle.

Hereinafter, structure of common antenna will be described with reference to accompanying drawing.

FIG. 1 is a view illustrating schematically a conventional antenna.

In FIG. 1, the antenna includes a reflection plate 100, a phase shifter 102, a tilting adjustment apparatus 104 and a shaft 106.

The phase shifter 102 is connected electrically to radiators, divides the power into the radiators, and is formed on the reflection plate 100.

The phase shifter 102 includes a rotation member 108, a dielectric substrate 110, a line 112, a central axis member 114 and an arm member 116.

The tilting adjustment apparatus 104 is connected to the rotation member 108 of the phase shifter 102 through the shaft 106, and provides rotatory power to the rotation member 108 through the shaft 106 to rotate the rotation member 108 during adjustment of the tilting angle. Since the rotation member 108 is connected to the arm member 116 through the central axis member 114, the arm member 116 rotates in response to rotation of the rotation member 108. As a result, amount of the power fed to the radiators connected to both ends of the line 112 changes, and so the direction of the beam outputted from the radiators is changed.

The rotation member 108 is disposed on a rear surface of the reflection plate 100 as shown in FIG. 1, but the arm member 116, etc. is disposed on an upper surface of the reflection plate 100. Accordingly, the central axis member 114 should be formed through the reflection plate 100 so as to connect the arm member 116 to the rotation member 108. As a result, characteristics of the antenna such as isolation, PIMD, etc. may be deteriorated.

In addition, many components should be used on the rear surface of the reflection plate 100 to fix the rotation member 108 to the reflection plate 100.

In case that a user means to use the antenna as another usage, e.g. in another frequency band, shifting rate of the arm member 116 (distance of the arm member 116 shifted while the tilting adjustment apparatus 104 rotates by one time) need to be changed from initial setting. However, since one antenna may not change the shifting rate, the tilting adjustment apparatus 104 or the phase shifter 102 should be exchanged or the antenna should be replaced with another antenna. As a result, utilization of the antenna is lowered and exchanging cost increases.

DISCLOSURE

Technical Problem

Example embodiments of the present invention provide dove tail devices for controlling operation of an arm member to prevent deterioration of characteristics of the antenna. The number of components of an antenna reduces by using the dove tail device and so cost for manufacturing the antenna decreases.

Technical Solution

In one aspect, the present invention provides a dove tail device in an antenna comprising: a guide; and a motion member configured to move on the guide. Here, the motion member is combined with a rotation arm of a phase shifter, the rotation arm rotates according as the motion member moves on the guide, and an arm member of the phase shifter rotates in response to rotation of the rotation arm.

The motion member moving on the guide includes: a first sub-motion member, wherein a home is formed on a center of the first sub-motion member; and a second sub-motion member combined with the home of the first sub-motion member, wherein a first hole is formed to an end part of the second sub-motion member. Here, a second hole is formed to an end part of the rotation arm, and a screw combines the second sub-motion member with the rotation arm through the holes.

The phase shifter further includes a dielectric substrate, the arm member locates above the dielectric substrate, the rotation arm locates below the dielectric substrate, third holes are formed to the arm member, the dielectric substrate and the rotation arm, the arm member, the dielectric substrate and the rotation arm are combined by disposing a central axis member through the third holes, and the arm member rotates in case that the rotation arm rotates.

The guide is fixed to a reflector, a shaft connected to a tilting adjustment apparatus is combined with a part of the first sub-motion member, and the motion member moves on the guide according as the shaft moves linearly.

A transformer is disposed between the tilting adjustment apparatus and the shaft, and the transformer moves linearly the shaft in response to rotational motion of the tilting adjustment apparatus.

The dove tail device further includes a first supporting member on which a third hole is formed; and a second supporting member. Here, one end of the rotation arm is inserted into the third hole of the first supporting member, and the screw combines the second sub-motion member with the rotation arm under the condition that the rotation arm is inserted into the third hole of the first supporting member.

The phase shifter further includes a first dielectric substrate and a second dielectric substrate disposed above and below, the arm member locates above the first dielectric substrate, and the rotation arm locates between the first dielectric substrate and the second dielectric substrate.

In another aspect, the present invention provides a dove tail device in an antenna comprising: a force delivering member configured to enable rotating and fixed to a reflector; and a motion member combined with the force delivering member. Here, the motion member moves on the force delivering member in response to rotation of the force delivering member under the condition that the motion member is combined with the force delivering member, the motion member is combined with a rotation arm of a phase shifter, the rotation arm rotates according as the motion member moves on the force delivering member, and an arm member of the phase shifter rotates in response to rotation of the rotation arm.

The motion member includes: a first sub-motion member configured to move on the force delivering member, wherein a home and a first hole are formed on the first sub-motion member; and a second sub-motion member combined with the home of the first sub-motion member, wherein a second hole is formed to an end part of the second sub-motion member. Here, a first thread is formed on an outer surface of the force delivering member, a second thread is formed on an inner surface of the first sub-motion member corresponding to the first hole, the first sub-motion member moves on the force delivering member in case that the force delivering member rotates, a third hole is formed on an end part of the rotation arm, and a screw combines the second sub-motion member with the rotation arm through the second hole and the third hole.

The phase shifter further includes a dielectric substrate, the arm member located above the dielectric substrate, the rotation arm located below the dielectric substrate, fourth holes are formed to the arm member, the dielectric member and the rotation arm, a central axis member combines the arm member, the dielectric member and the rotation arm through the fourth holes, and the arm member rotates in case that the rotation arm rotates.

The dove tail device further includes a first supporting member on which a fourth hole is formed; and a second supporting member. Here, one end of the rotation arm (corresponding to the third hole) is inserted into the fourth hole of the first supporting member, the screw combines the second sub-motion member with the rotation arm under the condition that the rotation arm is inserted into the fourth hole of the first supporting member.

The phase shifter further includes a first dielectric substrate and a second dielectric substrate disposed above and below, the arm member locates above the first dielectric substrate, and the rotation arm locates between the first dielectric substrate and the second dielectric substrate.

Advantageous Effects

A dove tail device and a transformer employed in an antenna of the present invention are made up of small number of components and the antenna does not use a rotation member for rotating a central axis member. Hence, the number of components in the antenna reduces and it is easy to manufacture the antenna.

In addition, in the antenna of the present invention, a motion member for controlling operation of an arm member and the arm member locate on the same surface of a reflector, and thus a hole is not formed on the reflector. As a result, characteristics of the antenna such as isolation, PIMD, etc. may not be deteriorated.

Furthermore, since the dove tail device in the antenna of the present invention uses the motion member which moves linearly, loss of a force may reduce when the force is delivered from a tilting adjustment apparatus to the arm member.

Moreover, the antenna of the present invention adjusts desired shifting rate by exchanging only the transformer, utilization of the antenna increases and an assembly process is simplified. Additionally, since the antenna is not replaced, cost for realizing the antenna having desired shifting rate of the arm member may reduce.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Hereinafter, embodiments of the present invention will be described in detail with reference to accompanying drawings.

Figure 1:
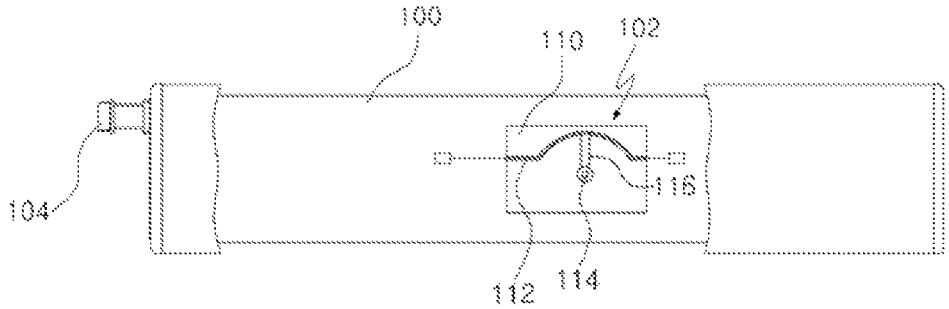
FIG. 1 RELATED ART
FIG. 1 is a view illustrating schematically a conventional antenna.
Figure 1:
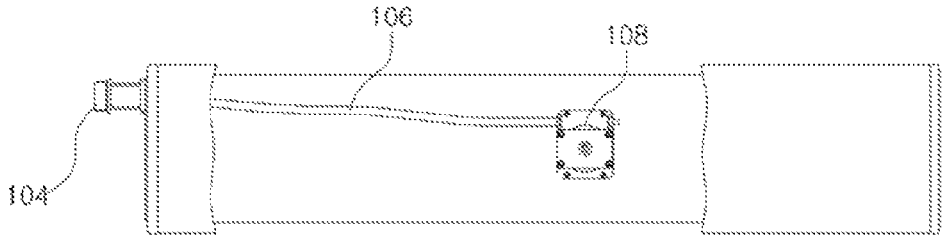
FIG. 1 RELATED ART
Figure 2:
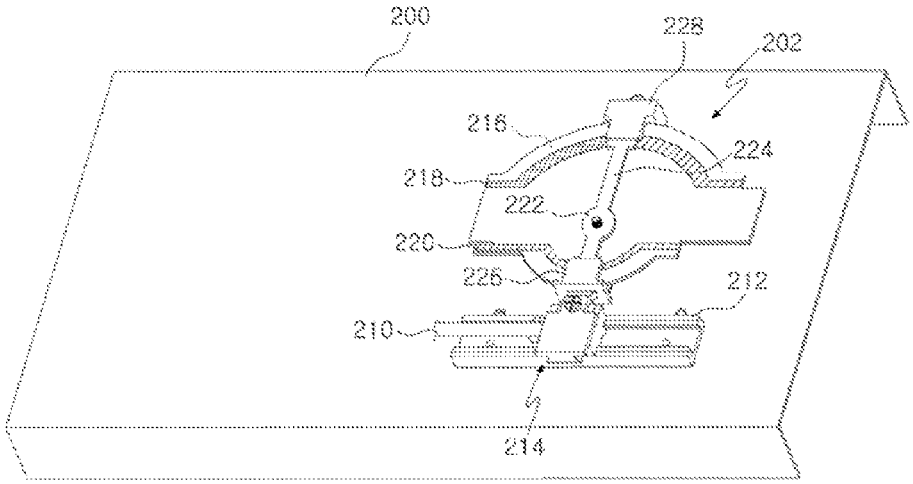
FIG. 2 is a view illustrating an antenna according to a first embodiment of the present invention.
Figure 2:
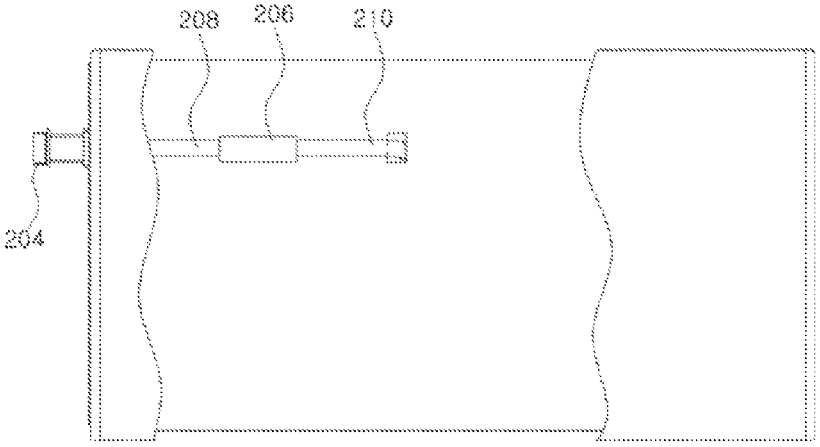

FIG. 2 is a view illustrating an antenna according to a first embodiment of the present invention.

In FIG. 2, the antenna of the present embodiment includes a reflector 200, a phase shifter 202, a tilting adjustment apparatus 204 and a dove tail device. Here, the dove tail device has a guide 212, a motion member 214 and support members 226 and 228.

The phase shifter 202 is disposed on one surface of the reflector 200.

One or more line 218 and 220 of the phase shifter 202 is connected electrically to at least one radiator (not shown). As a result, a power (RF signal) inputted through an input terminal (not shown) is divided into the radiators through a conducting line (not shown) formed on a lower surface of the arm member 224 and the lines 218 and 220. Accordingly, specific radiation pattern (beam) is outputted from the radiators.

The phase shifter 202 changes magnitude of the power fed to the radiators through a method of rotating the arm member 224, thereby changing direction of the beam, i.e. tilting angle outputted from the radiators.

The phase shifter includes a dielectric substrate 216, at least one line 218 and 220, a central axis member 222 and the arm member 224.

The tilting adjustment apparatus 204 rotates the arm member 224, and operates manually or automatically. Particularly, the tilting adjustment apparatus 204 rotates a first shaft 208 in accordance with a user's control under the condition that it is connected to the motion member 214 through the shafts 208 and 210 and the transformer 206. In this case, the transformer 206 converts rotational motion into a linear motion as described below, and thus a second shaft 210 moves linearly. Here, since the second shaft 210 is combined with the motion member 214, the motion member 214 shifts on the guide 212 in response to the linear motion. As a result, the arm member 224 rotates in response to movement of the motion member 214 as described below, and so the tilting angle of the antenna may be changed.

On the other hand, the user may control directly the tilting adjustment apparatus 204 using a hand or control remotely the tilting adjustment apparatus 204 using an electric motor.

Referring to the dove tail device, the guide 212 is fixed on the reflector 200, and the motion member 214 is combined with the guide 212. Particularly, a home is formed to a center of the guide 212, and the motion member 214 is combined with the guide 212 by inserting a lower part of the motion member 214 into the home.

The motion member 214 is combined with a rotation arm (not shown) for rotating the arm member 224 as described below under the condition that it locates on the guide 212. Particularly, the arm member 224 is connected to the rotation arm through the central axis member 222, and thus the arm member 224 rotates in response to rotation of the rotation arm in case that the motion member 214 moves on the guide 212. As a result, magnitude of the power fed to the radiators is changed, i.e. phase of the RF signal is changed. This will be described in detail with reference to accompanying drawings.

Hereinafter, structure and operation of the transformer 206 will be described.

Figure 3:
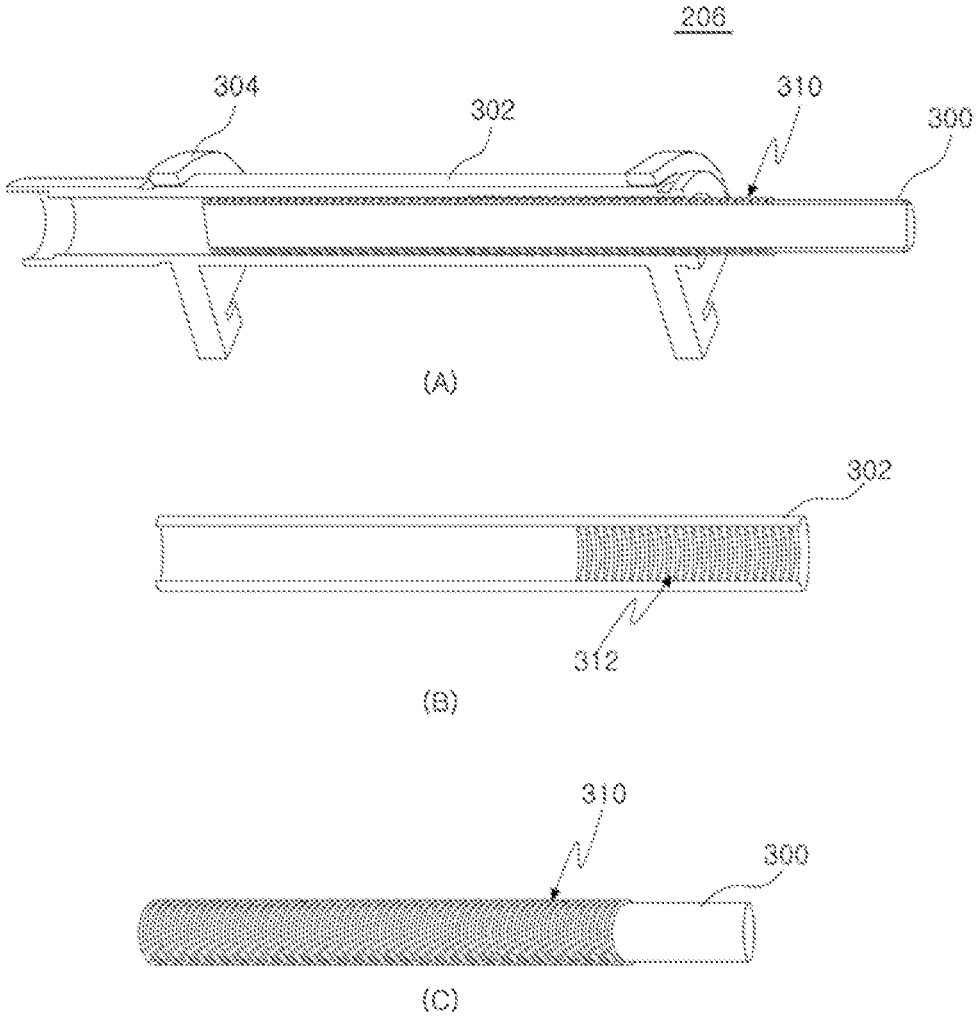
FIG. 3 is a sectional view illustrating a transformer according to one embodiment of the present invention.

FIG. 3 is a sectional view illustrating a transformer according to one embodiment of the present invention.

In FIG. 3(A), the transformer 206 includes a thread member 300 and a housing 302.

The thread member 300 is connected to the tilting adjustment apparatus 204 through the first shaft 208, and is connected to the second shaft 210. A first thread 310 is formed on an outer surface of the thread member 300 as shown in FIG. 3(C). That is, the thread member 300 may be multiple thread screw.

The housing 302 covers the thread member 300, and a second thread 312 is formed on inner surface of the housing 302 as shown in FIG. 3(B).

In other words, the first thread 310 is in gear with the second thread 312 as shown in FIG. 3(A), and so the thread member 300 moves linearly according to rotation of the tilting adjustment apparatus 204. Here, shift distance of the thread member 300 differs depending on number of lines of the first thread 310.

For example, in case that the thread member 300 is a double screw thread, the thread member 300 shifts by 2 pitch according as the tilting adjustment apparatus 206 rotates by one time. In case that the thread member is a quadruple screw thread, the thread member 300 shifts by 4 pitch according as the tilting adjustment apparatus 206 rotates by one time. Accordingly, a user may employ the thread member 300 having proper lines considering shifting rate of the arm member 224 (shifting distance of the arm member 224 changed while the tilting adjustment apparatus 206 rotates by one time).

Now referring to FIG. 3(A), the housing 302 may is connected stably to the reflector 200 by a fixing member 304.

That is, the transformer 206 converts rotational motion of the tilting adjustment apparatus 204 into linear motion, preferably may be made up of a multi thread screw to adjust shifting rate of the arm member 224. However, various methods except the method of using the multi thread screw may be used as the transformer 206 as long as the transformer 206 converts the rotational motion of the tilting adjustment apparatus 204 into the linear motion, i.e. the transformer 206 may be variously modified.

In brief, the antenna of the present embodiment controls operation of the phase shifter using the transformer 206 and the dove tail device.

The conventional antenna uses a rotation member locating in the direction opposed to the phase shifter on the basis of the reflection plate to control the phase shifter. In this case, many components such as a fixing member for fixing the rotation member, etc. should be used, and it is difficult to assemble the components. However, the antenna of the present invention uses the transformer 206 and the dove tail device having simple structure, and so the number of components of the antenna reduces and it is easy to assemble the components.

In addition, in the conventional antenna, a surface of the reflection plate on which the rotation member locates differs from that of the reflection plate on which the arm member locates, and thus a hole should be formed on the reflection plate. As a result, characteristics of the antenna such as isolation, PIMD, etc. may be deteriorated due to the hole. However, in the antenna of the present invention, the motion member 214 for controlling operation of the arm member 224 and the arm member 224 locate on the same surface of the reflector 200, and thus a hole need not to be formed on the reflector 200. Accordingly, the characteristics of the antenna may not be deteriorated.

Furthermore, the conventional antenna delivers the force generated by the tilting adjustment apparatus to the arm member through rotational motion method, and thus considerable loss of the force occurs. However, the antenna of the present invention delivers the force to the arm member 224 through the linear motion, and so loss of the force may reduce comparatively.

Moreover, in case that the user means to change the shifting rate of the arm member in the conventional antenna, many components such as the phase shifter, the tilting adjustment apparatus, etc. should be exchanged, or new antenna should be used instead of the antenna. However, the antenna of the present invention may realize desired shifting rate of the arm member 224 by exchanging only the transformer 206. Accordingly, utilization of the antenna of the present invention increases compared to that of the conventional antenna, and a process of assembling the components may simplify. In addition, since whole of the antenna is not exchanged, cost for establishing the antenna may reduce.

Hereinafter, a process of controlling the tilting angle of the antenna will be described.

Figure 4:
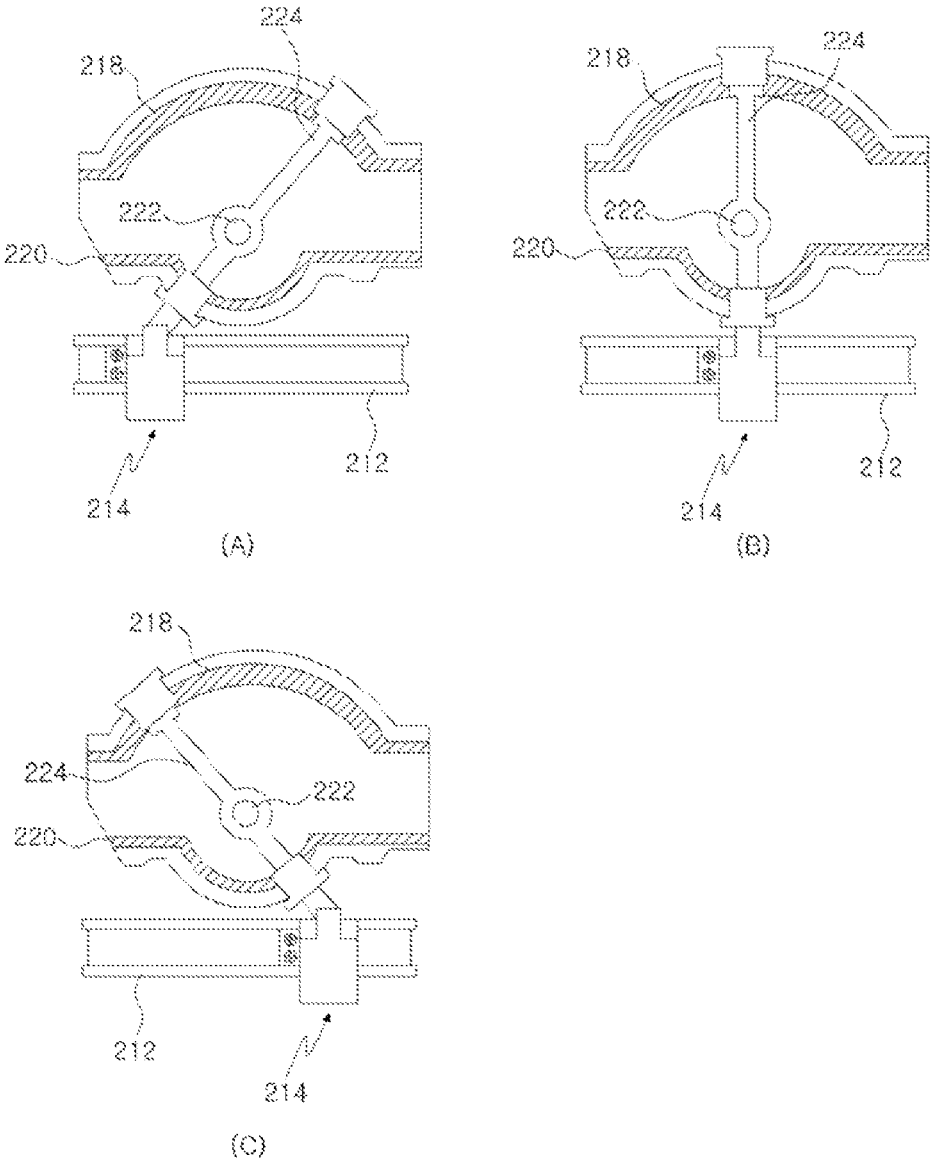
FIG. 4 is a view illustrating a process of adjusting the tilting angle according to one embodiment of the present invention.

FIG. 4 is a view illustrating a process of adjusting the tilting angle according to one embodiment of the present invention.

In FIG. 4(B), the arm member 224 and the motion member 214 may be disposed in the straight line in case that the motion member 214 locates at the center of the guide 212. Here, the motion member 214 may shift on the guide 212 by controlling the second shaft 210 as shown in FIG. 4(A) and FIG. 4(C). In this case, the arm member 224 rotates in accordance with shifting of the motion member 214 as shown in FIG. 4(A) and FIG. 4(C), and so the tilting angle of the antenna is changed.

In other words, the motion member 214 moves linearly on the guide 212, and the arm member 224 moves simultaneously in the direction of X axis and Y axis, i.e. does rotational motion in response to the linear motion of the motion member 214.

Hereinafter, detailed structure and operation of the dove tail device according to the present invention will be described in detail.

Figure 5:
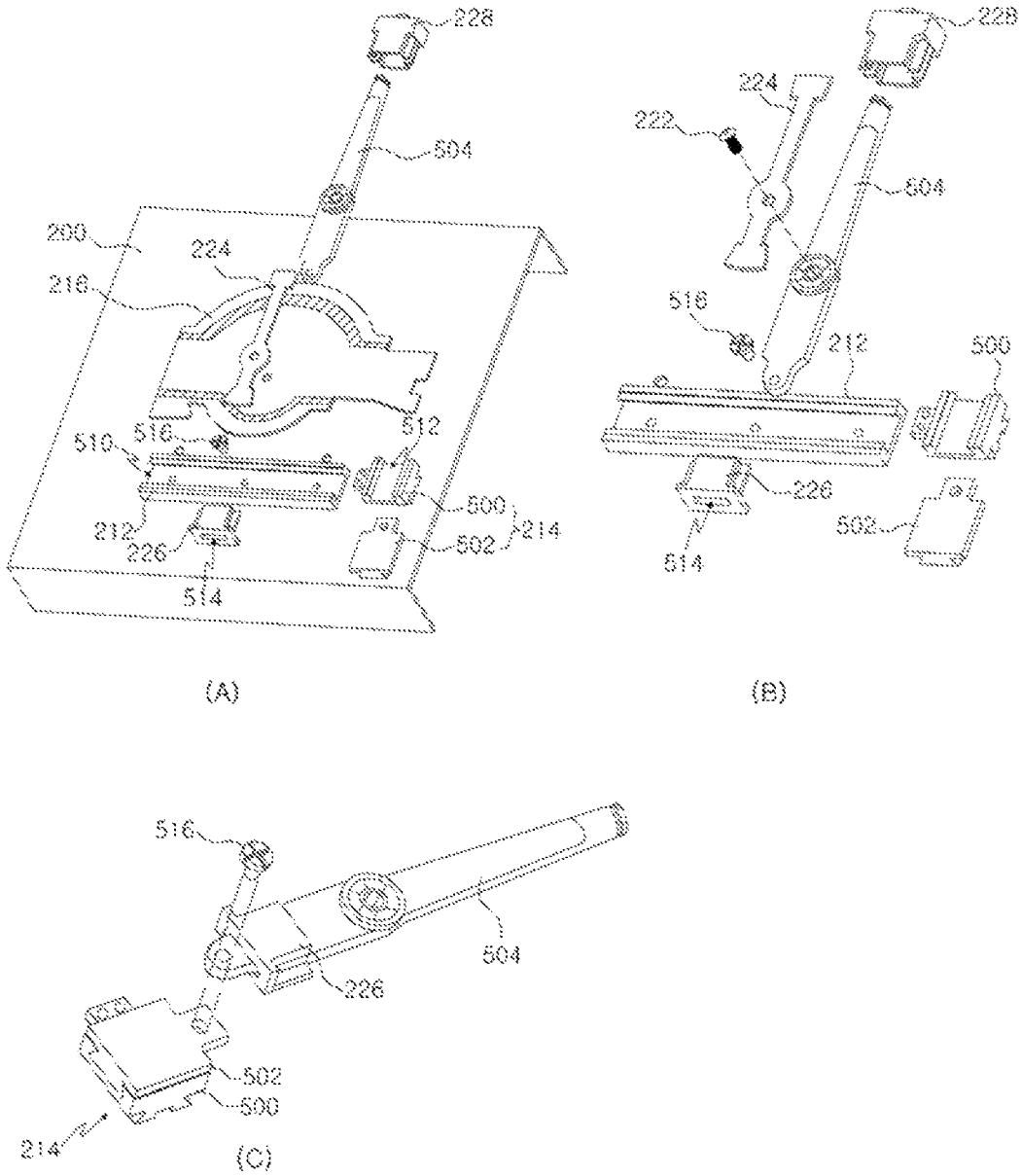
FIG. 5 is a perspective view illustrating a dove tail device according to one embodiment of the present invention.

FIG. 5 is a perspective view illustrating a dove tail device according to one embodiment of the present invention.

In FIG. 5, the motion member 214 includes a first sub-motion member 500 and a second sub-motion member 502.

The first sub-motion member 500 is combined with the guide 212, and a part (left part in FIG. 5) of the first sub-motion member 500 is combined with the second shaft 210.

In addition, a home 512 is formed on an upper part of the first sub-motion member 500.

The second sub-motion member 502 is combined with the first sub-motion member 500. Particularly, a lower part of the second sub-motion member 502 has a structure combined with the home 512 of the first sub-motion member 500 as shown in FIG. 5(A) and FIG. 5(B), and is combined with the first sub-motion member 500 as shown in FIG. 5(C). The first sub-motion member 500 moves on the guide 212 under the condition that the second sub-motion member 502 is combined with the first sub-motion member 500.

In FIG. 5(A), the phase shifter includes further the rotation arm 504. Here, the arm member 204 locates above the dielectric substrate 216, and the rotation arm 504 may locate between the reflector 200 and the dielectric substrate 216. The arm member 224 and the rotation arm 504 are connected by the central axis member 222 as shown in FIG. 5(B). As a result, the arm member 224 rotates in case that the rotation arm 504 rotates.

In FIG. 5(C), the rotation arm 504 is inserted into a hole 514 of a first supporting member 226 under the condition that it locates between the reflector 200 and the dielectric substrate 216. The rotation arm 504 is combined with the second sub-motion member 502 of the motion member 214 through specific screw 516. Particularly, a hole is formed at an end part of the rotation arm 504 and a hole is formed at an end part of the second sub-motion member 502 as shown in FIG. 5(C), and the screw 516 is disposed through the holes. As a result, the rotation arm 504 is combined with the second sub-motion member 502, and so the rotation arm 504 rotates in case that the motion member 214 moves on the guide 212 as shown in FIG. 4.

A projection member as well as the hole 514 is formed to the first supporting member 226, and the projection member supports the dielectric substrate 216.

The second supporting member 228 fixes stably the rotation arm 504.

In short, the second sub-motion member 502 is combined with the rotation arm 504 under the condition that the second sub-motion member 502 is combined with the first sub-motion member 500, and the arm member 224 and the rotation arm 504 are combined through the central axis member 222. As a result, the arm member 224 rotates in case that the motion member 214 moves on the guide 212, and so the tilting angle of the antenna may be adjusted.

In another embodiment of the present invention, the rotation arm 504 may fix the arm member 224 with locating above the arm member 224 not between the reflector 200 and the dielectric substrate 216, and be combined with the motion member 214. In other words, structure and location of the rotation arm 504 may be variously modified as long as the rotation arm 504 is combined with the motion member 214 and the arm member 224 and rotates the arm member 224.

Additionally, the motion member 214 may not be divided into the first sub-motion member 500 and the second sub-motion member 502, but be embodied with one body.

Figure 6:
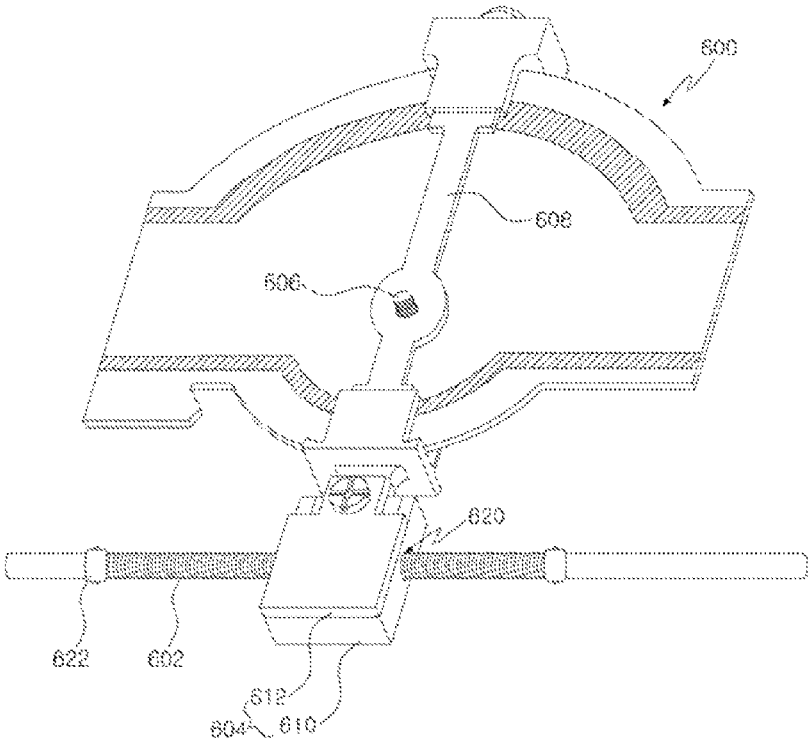
FIG. 6 is a perspective view illustrating an antenna according to a second embodiment of the present invention.

FIG. 6 is a perspective view illustrating an antenna according to a second embodiment of the present invention.

In FIG. 6, the antenna of the present embodiment includes a phase shifter 600 and a dove tail device.

The dove tail device includes a force delivering member 602, a motion member 604 and fixing members 622.

The force delivering member 602 is fixed to a reflector by the fixing members 622, and a first thread is formed to an outer surface of the force delivering member 602.

The motion member 604 includes a first sub-motion member 610 and a second sub-motion member 612 combined each other. Here, the second sub-motion member 612 is combined with a rotation arm like the first embodiment.

In the motion member 604, a hole 620 is formed on the first sub-motion member 610, and the force delivering member 602 is disposed through the hole 620. Here, a second thread is formed on an inner surface corresponding to the hole 620 of the first sub-motion member 610, and thus the first thread of the force delivering member 602 is in gear with the second thread of the first sub-motion member 610. In case that the force delivering member 602 rotates in accordance with control of a tilting adjustment apparatus, the motion member 604 moves on the force delivering member 602 because the force delivering member 602 is fixed to the reflector by the fixing members 622. Accordingly, a rotation arm and an arm member 608 rotate, and so the tilting angle of the antenna is adjusted. Since the above operation is similar to in the first embodiment, any further description concerning the operation will be omitted.

That is, in the antenna of the present embodiment, the motion member 604 moves on the force delivering member 602 on which the first thread is formed. Here, the force delivering member 602 is connected to a second shaft unlike the first embodiment in which the motion member 214 is connected to the second shaft 210. Furthermore, the antenna of the present embodiment does not include a transformer, and so a rotatory power is delivered directly to the force delivering member 602 in case that the rotatory power generates by the tilting adjustment apparatus. As a result, the force delivering member 602 rotates.

Figure 7:
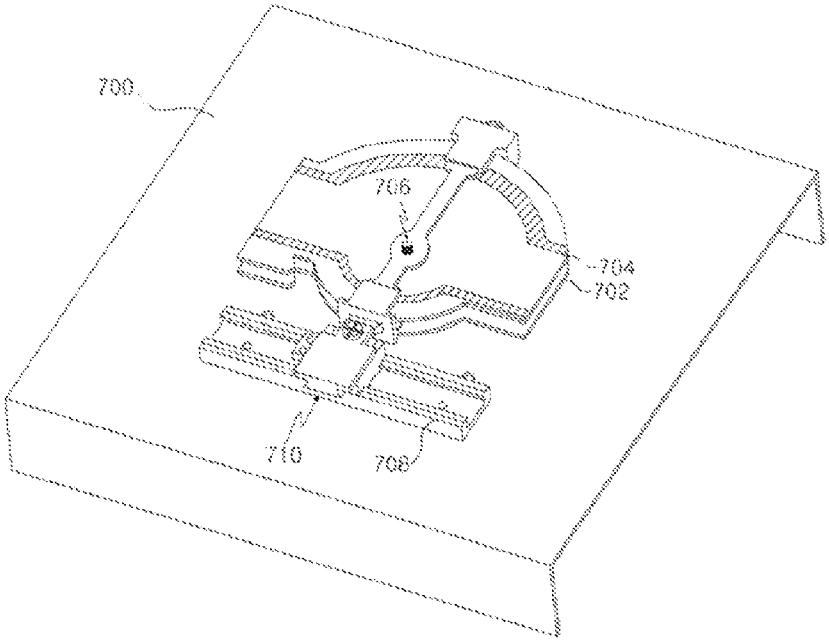
FIG. 7 is a perspective view illustrating an antenna according to a third embodiment of the present invention.

FIG. 7 is a perspective view illustrating an antenna according to a third embodiment of the present invention.

In FIG. 7, the antenna of the present embodiment includes a plurality of phase shifters 702 and 704.

The phase shifters 702 and 704 are disposed in sequence on a reflector 700, and is connected each other by a central axis member 706. Particularly, a first arm member of a first phase shifter 702, a second arm member of a second phase shifter 704 and a rotation arm are connected by the central axis member 706. Accordingly, the arm members rotate simultaneously in case that the motion member 710 moves on the guide 708.

In above description, the dove tail device includes a guide 708 and the motion member 710. However, the dove tail device may be made up of a force delivering member and a motion member like the second embodiment. Here, the rotation arm is connected to a motion member and the arm members, and locates preferably between the phase shifters 702 and 704.

In brief, referring to the first embodiment to the third embodiment, the dove tail device and the phase shifter, etc. may be variously modified as long as the arm member rotates in response to linear motion of the motion member.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A dove tail device in an antenna comprising:

a force delivering member configured to enable rotating and fixed to a reflector; and a motion member combined with the force delivering member, the motion member including:

a first sub-motion member configured to move on the force delivering member, wherein a first hole is formed on the first sub-motion member, and a second sub-motion member combined with the first sub-motion member;

wherein a first thread is formed on an outer surface of the force delivering member, a second thread is formed on an inner surface of the first sub-motion member corresponding to the first hole, the first sub-motion member moves on the force delivering member in case that the force delivering member rotates, the motion member is combined with a rotation arm of a phase shifter, the rotation arm rotates according as the motion member moves on the force delivering member, and an arm member of the phase shifter rotates in response to rotation of the rotation arm.

2. The dove tail device of claim 1, wherein a third hole is formed on an end part of the rotation arm, and a screw combines the second sub-motion member with the rotation arm through the second hole and the third hole.

3. The dove tail device of claim 2, wherein the phase shifter further includes a dielectric substrate, the arm member located above the dielectric substrate, the rotation arm located below the dielectric substrate, fourth holes are formed to the arm member, the dielectric member and the rotation arm, a central axis member combines the arm member, the dielectric member and the rotation arm through the fourth holes, and the arm member rotates in case that the rotation arm rotates.

4. The dove tail device of claim 2, further comprising:

a first supporting member on which a fourth hole is formed; and a second supporting member, wherein one end of the rotation arm (corresponding to the third hole) is inserted into the fourth hole of the first supporting member, the screw combines the second sub-motion member with the rotation arm under the condition that the rotation arm is inserted into the fourth hole of the first supporting member.

5. The dove tail device of claim 4, wherein the phase shifter further includes a first dielectric substrate and a second dielectric substrate disposed above and below, the arm member locates above the first dielectric substrate, and the rotation arm locates between the first dielectric substrate and the second dielectric substrate.

* * * * *